United States Patent [19]

Zipperian

[11] Patent Number: 4,735,709

[45] Date of Patent: Apr. 5, 1988

[54] METHOD AND APPARATUS FOR CONCENTRATION OF MINERALS BY FROTH FLOTATION USING DUAL AERATION

[75] Inventor: Donald E. Zipperian, Tucson, Ariz.

[73] Assignee: Deister Concentrator Company, Inc., Fort Wayne, Ind.

[21] Appl. No.: 5,916

[22] Filed: Jan. 21, 1987

Related U.S. Application Data

[63] Continuation-in-part of Ser. No. 752,465, Jul. 5, 1985, Pat. No. 4,639,313.

[51] Int. Cl.[4] ..... B03D 1/024

[52] U.S. Cl. ..... 209/164; 209/170; 210/221.2; 210/703; 261/76; 261/122

[58] Field of Search ..... 209/164, 170; 210/221.2, 703; 261/76, 122

[56] References Cited

U.S. PATENT DOCUMENTS

| | | | |
|---|---|---|---|
| 2,753,045 | 7/1956 | Hollingsworth | 209/170 |
| 2,758,714 | 8/1956 | Hollingsworth | 209/168 |
| 2,883,169 | 4/1959 | Danan | 209/170 |
| 3,298,519 | 1/1967 | Hollingsworth | 209/170 |
| 3,371,779 | 3/1968 | Hollingsworth | 209/170 |
| 4,287,054 | 9/1981 | Hollingsworth | 209/170 |
| 4,394,258 | 7/1983 | Zipperian | 209/170 |
| 4,431,531 | 2/1984 | Hollingsworth | 209/170 |
| 4,450,072 | 5/1984 | Suplicki | 209/170 |
| 4,617,113 | 9/1986 | Christopherson | 209/170 |
| 4,639,313 | 1/1987 | Zipperian | 209/170 |

*Primary Examiner*—S. Leon Bashore
*Assistant Examiner*—Thomas M. Lithgow
*Attorney, Agent, or Firm*—Pearne, Gordon, McCoy & Granger

[57] ABSTRACT

A froth flotation system for separating a mineral fraction from an aqueous pulp containing a mixture of mineral and gangue particles. The aqueous pulp is supplied to a pulp-filled vessel (or column) wherein a froth is formed on the surface of the pulp and collected in a launder. Gas bubbles are introduced into the pulp in the vessel by two different means to generate the froth. In accordance with one means, water is aspirated into a stream of pressurized gas (air) to form a stream of aerated water which is injected into the lower portion of the pulp-filled vessel. In accordance, the other means, a second stream of pressurized gas (air), is sparged through a porous wall of one or more micro-diffusers located within the vessel. The dual means for generating bubbles produces a significantly higher level of mineral separation than can be achieved from either means separately.

10 Claims, 3 Drawing Sheets

METHOD AND APPARATUS FOR CONCENTRATION OF MINERALS BY FROTH FLOTATION USING DUAL AERATION

CROSS REFERENCE TO RELATED APPLICATION

This application is a continuation-in-part of application Ser. No. 752,465 filed July 5, 1985, now U.S. Pat. No. 4,639,313.

BACKGROUND OF THE INVENTION

This invention relates to the separation of particulate material from an aqueous slurry by a froth flotation process and more particularly, to a flotation system with dual means for introducing the gaseous medium in the form of minute bubbles into the fluid vessel. In one stage, the gaseous medium is introduced by flowing pressurized gas, (air) through an eductor to aspirate water into the gaseous stream. In the other stage, the gaseous medium is introduced by sparging or in other words, by delivering compressed air to micro-diffusers within the flotation compartment, the diffuser or spargers housing a wall portion comprising a porous membrane. The compressed gas is forced through the minute pores in the spargers into the surrounding aqueous liquid to form small bubbles.

Commercially valuable minerals, for example, metal sulfides, apitictic phosphates and the like are commonly found in nature mixed with relatively large quantities of gangue materials. As a consequence, it is usually necessary to beneficiate the ores in order to concentrate the mineral content. Mixtures of finely divided mineral particles and finely divided gangue particles can be separated and a mineral concentrate obtained therefrom by well-known froth flotation techniques.

Broadly speaking, froth flotation involves conditioning an aqueous slurry or pulp of the mixture of mineral and gangue particles with one or more flotation reagents which will promote flotation of either the mineral or the gangue constituents of the pulp when the pulp is aerated. The conditioned pulp is aerated by introducing into the pulp a plurality of minute air bubbles which tend co become attached either to the mineral particles or to the gangue particles of the pulp, thereby causing one category of these particles, a float fraction, to rise to the surface of the body of pulp and form a froth which overflows or is withdrawn from the flotation apparatus. The other category of particles, a non-float fraction, tends to gravitate downwardly through the aqueous pulp, and it may be withdrawn at an underflow outlet from the flotation apparatus. Typical examples of such flotation apparatus for accomplishing the foregoing are disclosed in U. S. Pat. Nos. 2,753,045; 2,758,714; 3,298,519; 3,371,779; 4,287,054, 4,394,258, 4,431,531 and 4,617,113.

In such apparatus, the conditioned pulp is introduced into a flotation compartment containing a relatively quiescent body of aqueous pulp, and aerated water is introduced into the lower portion of the flotation compartment through orifices formed in the bottom wall of the flotation compartment. An overflow fraction containing floated particles of the pulp is withdrawn from the top of the body of aqueous pulp and an underflow or non-float fraction containing non-floated particles of the pulp is withdrawn from the pulp in the lower portion of the flotation compartment.

In several of the heretofore known systems, the aerated water is produced by first introducing a frother or surfactant into the water, which mixture is then passed through an eductor wherein air is aspirated into the water. In order to obtain a proper degree of aeration of the water, a high flow-rate of water, typically in excess of 1,000 gallons per minute, must be passed through the eductor. While recirculation systems have been devised to minimize the amount of "new" water added to the system, a significant expenditure in energy is required to move such large quantities of water.

A further problem encountered results from the difference between the concentrations of solid particles present in slurries of different minerals. Phosphates, for example, do not typically require extensive grinding in order to liberate the desired mineral components of the pulp. As a result, the aqueous slurry or pulp fed to the flotation apparatus typically consists of approximately seventy-five percent (75%) solids and twenty-five percent (25%) water. Sulfides, on the other hand, approach the obverse extreme and typically require extensive beneficiation through grinding the material to a very fine state in order to gain liberation of the desired minerals from the gangue.

The addition of water throughout the sorting, grinding and classifying stages of the beneficiation process provides a resulting aqueous slurry to the flotation device comprising approximately ten percent (10%) solid matter and ninety percent (90%) water. Thus, the addition of significant additional amounts of water through the introduction of the aerated water appears counterproductive in that significant amounts of the finely ground valuable minerals may avoid capture by the aeration bubbles and remain suspended within the liquid component of the slurry.

If a recirculation system is utilized, much of the finely ground material may be passed through the recirculation system which can cause silting of the recirculation system or loss of a significant quantity of finely ground valuable minerals or both. Ideally, to avoid loss of such valuable minerals, additional water should be introduced into the aerated water. This in turn has heretofore required the introduction of still greater additional amounts of water to the system. An excellent solution to the problem discussed above is disclosed in my co-pending U.S. patent application Ser. No. 752,465 (now U.S. Pat. No. 4,639,313) wherein aerated water for the flotation apparatus is produced by flowing pressurized air through an eductor, aspirating water into the air at the eductor, and, if desired, introducing the surfactant or frother into the water prior to its aspiration. This system minimizes the amount of water required and permits the varying of the concentration of air in the introduced aerated water without significantly varying the water flow-rate.

While this method achieves excellent results, it has been found that in order to obtain a deeper froth column, a higher water pressure is required. The higher pressure however, again results in excessive water, thus to some extent creating the same type of problem as to water requirements that was discussed above.

The method and apparatus of the present invention however, resolve the difficulties outlined above and afford other features and advantages heretofore not obtainable.

SUMMARY OF THE INVENTION

It is a primary object of the present invention to provide a flotation apparatus for the concentration of minerals which optimizes the separation efficiency.

Another object is to achieve the above result with a minimal amount of water inflow.

A further object is to provide a flotation apparatus of the type described with the capability of varying the supply of air without significantly varying the water flow-rate.

Still another object of the invention is to provide a flotation apparatus for the concentration of minerals requiring significantly reduced operating energy conption, thereby providing more economic operation.

These and other objects and advantages are achieved with the unique method and apparatus of the invention wherein the concentration of minerals by froth flotation from an aqueous pulp is achieved by introducing the aqueous pulp at the upper portion of the enclosed vessel containing the liquid medium on which a froth is formed. The vessel is separated vertically into a flotation compartment with a perforated floor adapted to collect and discharge non-float particles from the aqueous pulp, and a distribution compartment below the perforated floor adapted to receive a continuous supply of the aerated water.

In accordance with the invention, air is introduced into the vessel by generating a stream of pressurized gas, aspirating a quantity of aqueous liquid (water) into the stream of pressurized gas, turbulently mixing the resulting stream of gas and aqeous liquid to form a stream of aerated water and then introducing the stream of aerated water into the distribution compartment.

Simultaneously, a second stream of pressurized gas is generated and supplied to spargers or microdiffusers located in the flotation compartment, the spargers having a porous wall through which the sparged gas emerges in the form of small bubbles.

The use of the two means for introducing gas or air into the flotation compartment unexpectedly increases the efficiency of mineral separation and achieves surprisingly improved results.

DESCRIPTION OF THE PREFERRED EMBODIMENT

Figure 1:
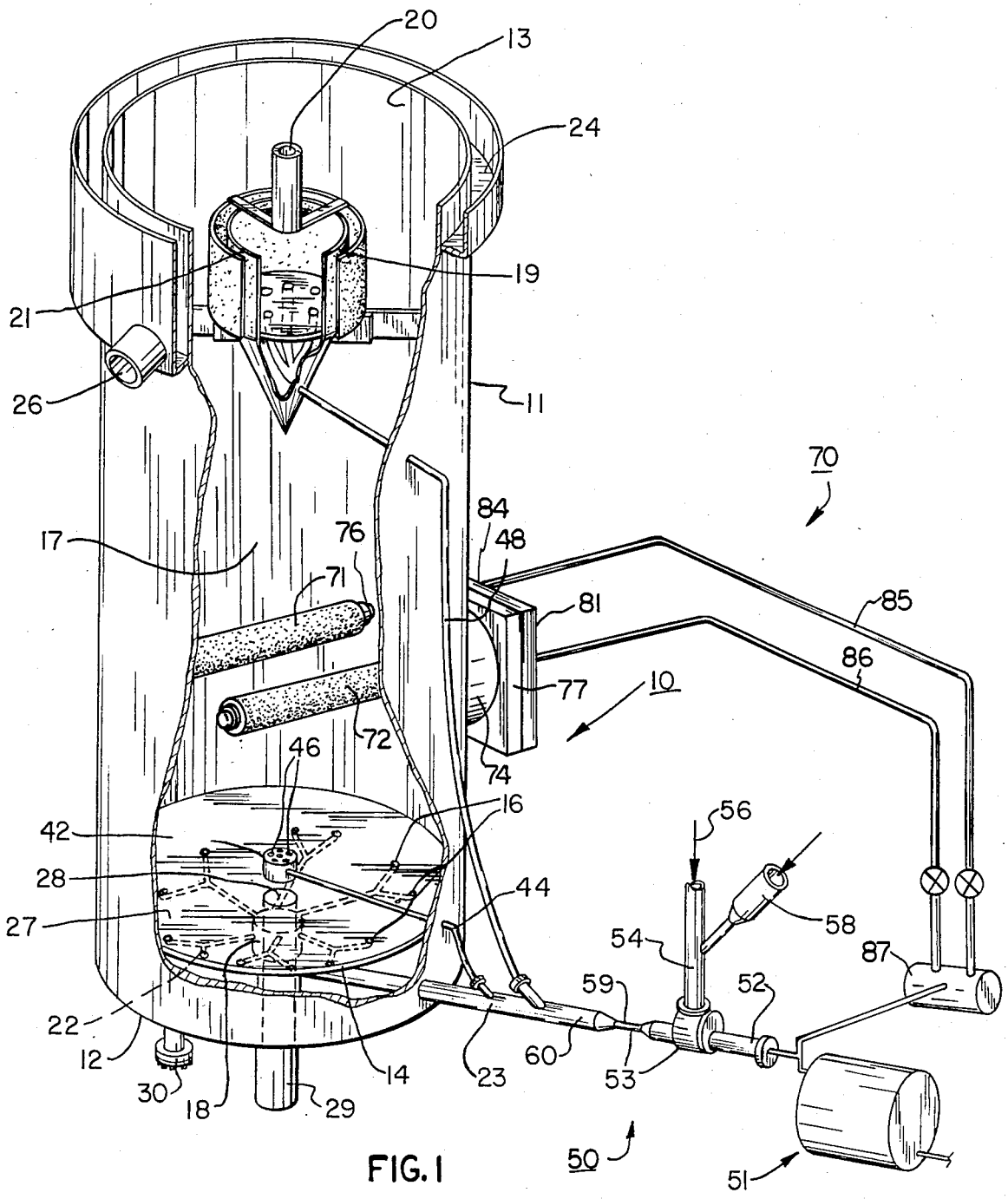
FIG. 1 is a perspective view partially broken away in section for clarity of illustration, of a flotation apparatus of the type to which the present invention relates.

The flotation apparatus of the invention includes as its principle components, a fluid vessel or cylinder 10, an eductor system 50 for introducing gaseous medium or air into the vessel, and a sparging system 70 for introducing additional gaseous medium or air into the vessel.

The flotation vessel 10 is formed as an upright circular cylinder having a vertical wall 11 and a bottom wall 12. The flotation cylinder is typically open at the upper end 13. A substantially horizontally-disposed constriction plate 14 is located within the cylinder to separate the cylinder into a flotation compartment 17 above the constriction plate 14 and a distribution compartment 18 below the constriction plate 14. The constriction plate has a plurality of orifices 16 to permit passage of aerated water from the distribution compartment 18 to the flotation compartment 17.

A pulp feed well 19 is supported within the upper end portion 13 of the flotation compartment 17. A feed tube 20 from an external source of aqueous slurry is generally provided to deliver a controlled quantity of the aqueous slurry to the feed well 19. The feed well 19 has an overflow baffle 21 and it may include baffles (not shown) so that the aqueous slurry fed into the feed well 19 becomes distributed throughout the flotation compartment 17.

The introduction of a flow of aerated water into the flotation compartment 17 through the distribution compartment 18 tends to produce a higher static pressure of the aerated water within the distribution compartment 18 than that in the aqueous slurry within the flotation compartment 17 immediately above the constriction plate 14. This causes the aerated water contained in the distribution compartment 18 to flow upwardly through the orifices 16 in the constriction plate 14, thereby inhibiting any downward flow of aqueous slurry, or the particulate matter suspended therein through the orifices 16. An aerated water feed line 23 enters the distribution compartment 18 through the cylinder wall 11 and conveys aerated water from the eductor system 50 to the distribution manifold 22.

In addition to precluding the downward migration of aqueous slurry, or solid particulate matter, suspended therein, through the orifices 16 in the constriction plate 14 by the flow of aerated water upwardly through the orifices 16, the aerated water within the compartment 18 contains a multitude of minute air bubbles which levitate through the aqueous slurry within the flotation compartment 17.

Aided by the inclusion of an appropriate reagent, commonly known as a collector, either the particles of the desired valuable mineral or the particles of the gangue suspended in the aqueous slurry adhere to the rising air bubbles and collect at the upper end of the flotation compartment 17 in the form of a froth.

A launder 24 is provided at the upper end 13 of the cylinder wall 11 and is adapted to receive the froth which overflows from the flotation compartment 17. An output conduit 26 is provided to convey the overflowing froth from the launder 24 to further processing or storage apparatus.

Figure 2:
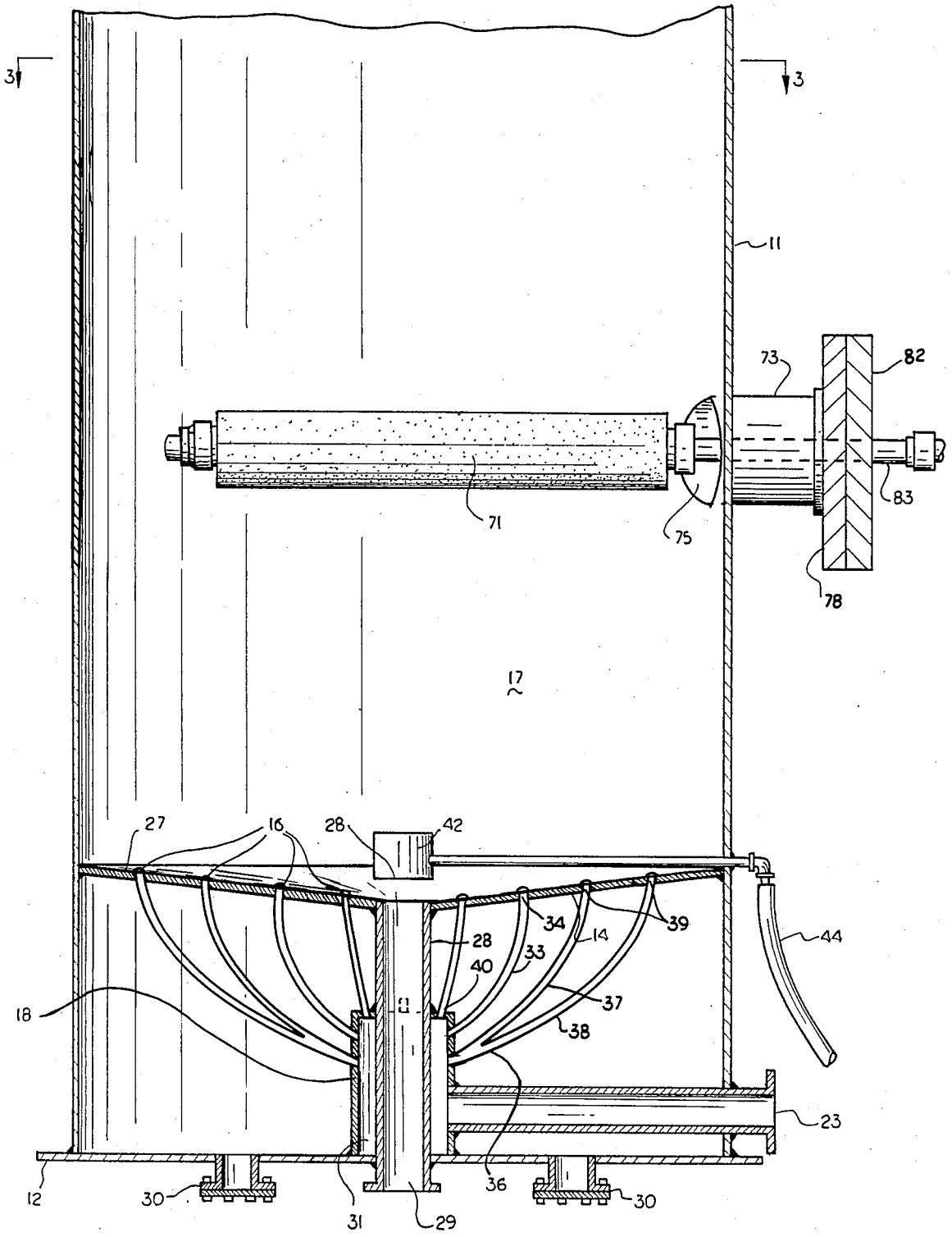
FIG. 2 is a fragmentary vertical view on an enlarged scale of the flotation apparatus of FIG. 1.

The solid matter not captured by the levitating air bubbles gravitates downwardly through the aqueous slurry until it reaches the vicinity of the constriction plate 14. As shown in FIG. 2, the constriction plate 14 has a downwardly concave surface 27. The continued gravitation of the solid particles continues along the upper surface 27 of the constriction plate 14 until it reaches the central portion. An opening 28 is formed through the center of the constriction plate 14 into which the gravitating non-float fraction passes. An underflow duct 29 is conducted to the rim of the hole 28 to provide a passage through the bottom wall 12 of the cylinder.

The aerated water feed line 23 is connected to an annular distribution chamber 31 that surrounds the underflow duct 29.

The aerated water feed line 23 enters the chamber 31 at its lower portion tangential to the outer wall of the underflow duct 29 so that the aerated water will circulate cyclonically through the chamber. A plurality of distribution pipes extend outwardly from the upper portion of the distribution compartment 18 in a manner providing for introduction of aerated water into the flotation compartment 17 through the constriction plate 14.

In the preferred embodiment, two sets of distribution pipes are utilized. The distribution pipes 33 of a first type extend tangentially outward in a horizontal plane from the uppermost portion of the distribution chamber 31, each terminating in an upwardly directed nozzle 34. The nozzles 34 are located in a circular pattern with a circle diameter about half that of the hydraulic compartment 18.

The distribution pipes 36 of a second type are disposed to extend tangentially outward from the distribution chamber 31 at a level below the distribution pipes 33. Each of the pipes 36 branches into two arms 37 and 38, each terminating in an upwardly directed nozzle 39.

The tangential coupling of the aerated feed line 23 to the distribution chamber 31 tends to cause the aerated water entering the chamber 31 to swirl in a clockwise pattern when viewed from the top. The tangential coupling of the distribution pipes 33 and 36 to the distribution chamber 31 also encourages the swirling or cyclonic motion.

In the preferred embodiment, three additional nozzles 40 are coupled to an upper face of the distribution chamber 31 to provide for distribution of aerated water in the central portion of the flotation compartment 17.

Since that portion of the flotation compartment 17 above the hole 28 in the constriction plate 14 to which the underflow duct 29 is attached may not be provided with aerated water flowing upwardly through the orifices 16 of the constriction plate 14, an auxiliary water distribution manifold 42 may be incorporated within the lower portion of the flotation compartment 17. The auxiliary distribution manifold 42 includes a distribution cylinder that is provided with aerated water by a secondary water feed line 44 entering through the cylinder wall 11 from a coupling with the water feed line 23.

The cylinder is provided with a plurality of nozzles 46 adapted to provide a distribution of levitating air bubbles over the hole 28 in the constriction plate 14.

The aerated water feed line 23 may include still another branch 48 that is directed to the feed well 19 through the top of the flotation compartment 17. The supply of aerated water to the feed well 19 in this matter is well understood and is described more fully in U.S. Pat. No. 4,394,258

The Eductor System

The aerated water supplied to the water feed line 23 is obtained from the eductor system broadly indicated in FIG. 1 by the numeral 50. In this system, the primary flow medium is compressed air, typically at a pressure of around 20 pounds per square inch. Atmospheric air is compressed and stored in an accumulator 51. An enclosed air-flow passage or tube 52, directs the compressed air from the accumulator to an eductor 53.

Within the eductor 53, the compressed air flows past an aspirating opening (not shown) to which an input water line 54 is attached. Input water, at slightly less than compressed air pressure, is drawn by aspiration induced by the air flowing through the eductor 53 past the opening, into the input line 54 from an external water source 56.

A quantity of a desired surfactant or frother may be introduced into the water through a valve port 58 so as to enter and mix with the flowing aspirated water in the input water line 54. The flowing air, aspirated water and surfactant are then passed through a venturi 59 formed in the eductor 53, in which the flow-rate and pressure relationship create a turbulence to combine the air into the aspirated water along with the surfactant. As a result, a multitude of small bubbles is produced in the aerated water.

The aerated water is then conveyed through the pipe 60 to the aerated water feed line 23 for delivery to the distribution compartment 18.

The rate of air flow into the eductor 53 may be varied over a wide range without significantly altering the flow-rate of water into the eductor 53 and thence into the flotation compartment 17. Thus, the concentration of air bubbles in the aerated water obtained from the eductor 53 may be closely controlled by varying the flow-rate of the compressed air from the reservoir 51, with the flow-rate of aerated water varying only slightly in response to changes in air-flow rate.

The Sparging System

Figure 3:
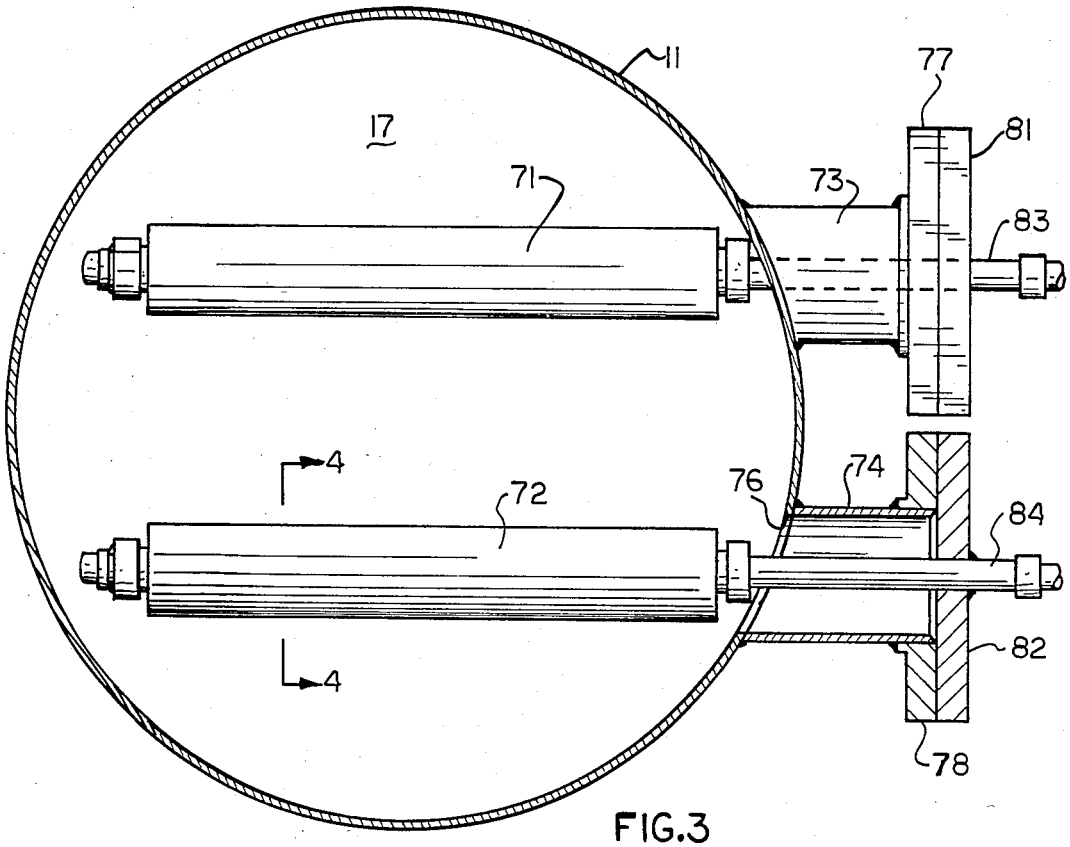
FIG. 3 is a sectional view taken on the line 3—3 of FIG. 2.
Figure 4:
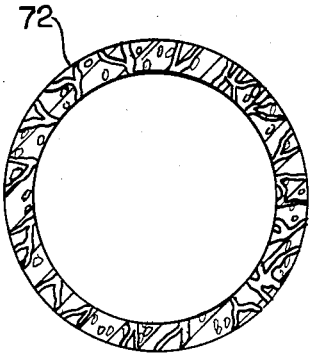
FIG. 4 is a cross-sectional view on an enlarged scale taken on the line 4—4 of FIG. 3.

The second means for introducing minute air bubbles into the vessel comprises a sparging system broadly identified by the numeral 70. This system produces bubbles in the flotation compartment by sparging or microdiffusing a gaseous medium through a porous wall. The system 70 comprises a pair of tubular cylindrical microdiffusers or spargers 70 that are located in the flotation compartment in a horizontal position parallel to one another. The spargers 71 and 72 are best shown in FIGS. 2, 3 and 4.

The construction of spargers is well-known in the art and several types may be used with good results. In particular, spargers formed of sintered, stainless steel having a porous wall with a typical pore size of 50 microns, have been successfully used. Other materials for spargers or micro-diffusers are porous plastics, fabrics, ceramics and rubber. While a small pore size is desirable, the pore size must not be so small as to become easily clogged. A wide rangeof pore sizes both smaller and larger than 50 microns may be found to work successfully.

The spargers 71 and 72 are mounted in the vessel 10 by means of tubular cylindrical housings 73 and 74 which are welded to the wall 11 and which communicate with the flotation chamber through circular openings 75 and 76 cut into the wall 11. The outer ends of the housings 73 and 74 have annular flanges 77 and 78 which in turn are welded to end blocks 81 and 82 that serve to close the outer ends of the housings 73 and 74 but which have a central opening for air supply pipes 83 and 84.

The pipes 83 and 84 are securely mounted to support the spargers 71 and 72 in cantilever fashion in the desired location within the flotation chamber. The outer ends of the pipes are connected by couplings to flexible hoses 85 and 86 which extend from a manifold 87 which in turn, communicates with the reservoir 51.

As shown in FIG. 4, the spargers are essentially tubular cylinders closed at the outer ends and communicating at the inner end with the pipes 83 and 84. The cylindrical walls of the spargers are porous as indicated so that the pressurized gas or air within the cylindrical chambers is forced through the pores into the liquid medium in the flotation chamber.

Sparging produces a bubble size somewhat larger than the bubbles produced by the eductor system 50 described above. However, it is believed that the simultaneous operation of the two systems (thus producing bubbles of varying sizes) produces an effect that enhances the ability of the bubbles to adhere to mineral particles.

Also, it has been found that optimum results are achieved when the volume of air supplied through the spargers is approximately equal to the volume of air supplied through the eductor system.

The invention and the results achieved therefrom will be better understood by reference to the following examples:

EXAMPLE 1

A flotation column of the type described was supplied with an aqueous slurry of copper ore having an ore concentration of about 30%. Aspirator-generated air bubbles were produced in the manner described above with compressed air flowing at a rate of 10 cubic feet per minute at a pressure of 14 psi. Water was supplied at a rate of 14 gallons per minute, the water containing 94 ppm of polypropylene glycol as the frothing agent. Sparger-generated air bubbles were produced by passing air at a flow-rate of 5 cubic feet per minute at a pressure of 10 psi through three 12 inch long spargers of 2 inch diameter. The spargers were located in the lower portion of the flotation compartment in approximately the position illustrated in FIGS. 1 and 2. The ratio of aspirator-generated air bubbles to the total amount of aspirator-generated and sparger-generated air bubbles was varied from 100% to 0 as shown in the left-hand column. Four runs were made using different ratios in each. The results with respect to the mineral concentration obtained in the froth overflow are shown in Table I below:

TABLE I

| Run | Aspirator-Generated Air Bubbles % | Sparger-Generated Air Bubbles % | Copper Recovery Based On Original Ore Assay % |
|---|---|---|---|
| 1 | 100 | 0 | 59.1 |
| 2 | 75 | 25 | 90.4 |
| 3 | 50 | 50 | 97.9 |
| 4 | 0 | 100 | 49.6 |

It is apparent from TABLE I that optimum results are achieved when the ratio of sparger-generated bubbles to aspirator generated bubbles is about 50/50.

EXAMPLE 2

A column flotation cell in accordance with the invention was provided with coal-washing plant fines in an aqueous slurry. Aspirator-generated air bubbles and sparger-generated air bubbles were produced and supplied to the flotation column in the manner described in Example 1. The ratio of aspirator-generated air bubbles to the total amount of air bubbles was varied from 100% to 0 as shown in the left-hand column. The results (based on the ash content of the tailings) of four different runs are shown in TABLE II below:

TABLE II

| Run | Aspirator-Generated Air Bubbles % | Sparger-Generated Air Bubbles % | Ash Content of the Tailings % | Coal Recovery Calculated by Ash Balance Formula % |
|---|---|---|---|---|
| 1 | 100 | 0 | 60.1 | 83.7 |
| 2 | 64 | 36 | 65.9 | 85.2 |
| 3 | 45 | 55 | 78.2 | 87.7 |
| 4 | 0 | 100 | 40.5 | 74.6 |

It is apparent from the results that optimum results were achieved when the ratio of sparger-generated air bubbles was about 50/50.

While the invention has been shown and described with respect to a specific embodiment thereof, this is intended for the purpose of illustration rather than limitation, and other variations and modifications of the specific method and device herein shown and described will be apparent to those skilled in the art all within the spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A method for separation of minerals by froth flotation from an aqueous pulp containing a mixture of mineral and gangue particles, wherein the aqueous pulp is supplied to an enclosed vessel containing a liquid medium having an upper surface on which a froth containing floated mineral particles is formed comprising the steps of:

generating a stream of pressurized gas;

aspirating a quantity of water into the stream of pressurized gas;

turbulently mixing the resulting stream of gas and water to form a stream of aerated water;

introducing the stream of aerated water into the vessel beneath the surface of the liquid medium;

simultaneously generating a second stream of pressurized gas; and sparging the gas of the second stream into the vessel beneath the surface of the liquid medium through a porous wall of a micro-diffusing means located within said vessel.

2. A method as defined in claim 1 wherein the quantity of gas introduced into said vessel by sparging is from about 40% to about 60% of the total quantity of gas introduced.

3. A method as defined in claim 2 wherein the quantity of gas introduced into said vessel by sparging is about 50% of the total quantity of gas introduced.

4. A method as defined in claim 1 wherein said vessel is separated vertically into a flotation compartment at the upper end with a perforated floor adapted to collect gangue particles from the aqueous pulp, and a distribution compartment below said perforated floor and adapted to receive a continuous supply of said aerated water.

5. A method as defined in claim 4 wherein said stream of aerated water is introduced into said distribution compartment and said second stream of pressurized gas is sparged into said flotation compartment.

6. A method as defined in claim 1 wherein the micro-diffusing means comprises at least one closed tubular element located in said vessel and communicating with said second stream of pressurized gas, said element having a porous cylindrical wall.

7. A method as defined in claim 6 wherein said porous cylindrical wall has pores with a size of about 50 microns.

8. A method as defined in claim 6 wherein said closed tubular sparging element is formed of sintered stainless steel.

9. A method as defined in claim 6 wherein said closed tubular sparging element is formed of porous plastic material.

10. A method for separation of minerals by froth flotation from an aqueous pulp containing a mixture of mineral and gangue particles, wherein the aqueous pulp is supplied to an enclosed vessel containing a liquid medium having an upper surface on which a froth containing floated mineral particles is formed, the froth being collected in a launder, and which is separated vertically into a flotation compartment with a perforated floor adapted to collect and discharge gangue particles from the aqueous pulp, and a distribution compartment below the perforated floor and adapted to receive a continuous supply of aerated water, comprising the steps of:

generating a stream of pressurized gas;

aspirating a quantity of water into the stream of pressurized gas;

turbulently mixing the resulting stream of gas and water to form a stream of aerated water;

introducing the stream of aerated water into the distribution compartment;

simultaneously generating a second stream of pressurized gas; and sparging the gas of the second stream into the flotation compartment through a porous wall of a microdiffusing means located within the flotation compartment.

* * * * *